US007121903B2

(12) United States Patent
Sakaguchi et al.

(10) Patent No.: US 7,121,903 B2
(45) Date of Patent: Oct. 17, 2006

(54) TERMINAL

(75) Inventors: Tadahisa Sakaguchi, Shizuoka (JP); Masanori Onuma, Shizuoka (JP); Nobuyuki Asakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/229,799

(22) Filed: Sep. 20, 2005

(65) Prior Publication Data

US 2006/0068653 A1 Mar. 30, 2006

(30) Foreign Application Priority Data

Sep. 27, 2004 (JP) ..... 2004-279221
Sep. 27, 2004 (JP) ..... 2004-279222
Sep. 27, 2004 (JP) ..... 2004-279223

(51) Int. Cl.
*H01R 4/10* (2006.01)
*H01R 4/18* (2006.01)
*H01R 4/02* (2006.01)

(52) U.S. Cl. ..... 439/877; 439/910

(58) Field of Classification Search ..... 439/488, 439/874, 877, 910
See application file for complete search history.

(56) References Cited

U.S. PATENT DOCUMENTS 2,371,469 A * 3/1945 Rogoff ..... 439/877
3,051,773 A * 8/1962 Batcheller ..... 174/94 R
6,558,208 B1 * 5/2003 Suzuki ..... 439/878

FOREIGN PATENT DOCUMENTS

JP 10-125363 5/1998
JP 2005-197159 7/2005

* cited by examiner

*Primary Examiner*—James R. Harvey
(74) *Attorney, Agent, or Firm*—Armstrong, Kratz, Quintos, Hanson & Brooks, LLP

(57) ABSTRACT

The terminal includes a front portion, a middle portion, and a rear portion. The rear portion is opened and has a pair of upright segments. The front portion is a shape of hollow cylinder and has bent tips. The middle portion is partly opened and an inner edge thereof has a collapsed or chamfered face. A step H is disposed between the rear portion and the front portion so that the middle portion is downwardly tapered to the rear portion. A through-hole is disposed at inner wall of the middle portion close to the rear portion for a part of the core wires, preferably edges of the covers also, to be visible through the through-hole.

10 Claims, 8 Drawing Sheets

TERMINAL

BACKGROUND OF THE INVENTION

1. Field of the Invention

The present invention relates to a terminal to be connected to covered electric wires, particularly to a terminal to be connected to the covered electric wires without feazing or bending exposed core wires, more particularly to a terminal preventing core wires from being cut when the core wires are depressed with pressure, and further particularly to a terminal for a waterproof agent to penetrate below core wires uniformly.

2. Description of the Related Art

In an assembly of a wiring harness, an insertion of covered electric wires to a terminal or the fixing of the terminal is carried out manually with hand tools or swaging machines. Problems arising at the assembly are explained by referring to drawings.

FIG. 7 is a perspective view to explain a conventional terminal and an insertion of covered electric wires. FIG. 8 is a sectional view of FIG. 7 and a drawing to explain problems of the conventional type.

As shown in FIGS. 7 and 8, a plurality of covered electric wires 2 with a prescribed length of core wires 22 exposed by removing covers 21 are inserted into a sleeve terminal 9. Since there are many core wires 22 in the each covered electric wire 2, the covered electric wires are inserted into the terminal 9 in an arrow direction without feazing or bending the core wires 22.

JP,2005-197159,A discloses a prior art of an insertion method of covered electric wires.

As shown in FIG. 8, the conventional terminal 9 has a small opening G with a planar insertion edge 91 so that it is quite difficult to insert the core wires 22 into the terminal 9 without feazing or bending them.

Accordingly, when the core wires 22 are inserted into the terminal 9, it is necessary to watch around the insertion edge 91 for the core wires 22 not to feaze or bend so that the handling is quite difficult and the workability is reduced. Furthermore, the feazing and bending of the core wires 22 cause an increase of electric resistance or a decrease of fitting strength, resulting to a low reliability of connection.

FIG. 16 shows a perspective view of a conventional terminal. FIG. 17 shows a problem of the conventional terminal. Reference numerals in FIG. 17 correspond with those of FIG. 16.

As shown in FIG. 16, the conventional terminal 9' includes an electric connection portion 92' having an insertion through-hole 93' at a front side to connect a terminal of electric instruments and upright segments 91' at a base side to fix covers 21' of covered electric wires 2'. Core wires 22' exposed from the covers 21' with a prescribed length are thermo-compression bonded or ultrasonic bonded to the terminal 9' with an electrode or horn.

JP,H10-125363,A discloses a prior art related to the conventional terminal.

As shown in FIG. 17, when a front portion of the core wires 22' is pressure-bonded to the terminal 9' as shown by a large arrow, the core wires 22' near to and in an upper position of the covers 21' are pulled rapidly in a slim arrow direction. Accordingly, the upper portion of the core wires 22' is forced to deform and is cut. The problem often occurs when the covers' 21 are thick or a large number of the covered electric wires 2' are utilized so that a difference of outer diameters between a bundle of the core wires 22' and a bundle of the covers 21' is large. The cutting of the core wires 22' increases electrical resistance and decreases the fixing strength, resulting to a decrease of connection reliability.

In an assembly of a wiring harness, after covered electric wires are inserted into a terminal and fixed with upright segments, a waterproof agent is applied to the terminal. There is a problem in a conventional assembly as described below.

FIG. 24 is a perspective view of a conventional terminal. FIG. 25 is an illustration explaining the problem. The reference numerals of FIG. 24 correspond with those of FIG. 25.

As shown in FIG. 25, the conventional terminal 9" includes an electric connection portion 92" having an insertion through-hole 93" at a front side to connect a terminal of electric instruments and upright segments 91" at a base side to fix covers 21" of covered electric wires 2".

In order to obtain a waterproof of the terminal 9", the core wires 22" of the covered electric wires 21" are covered with a heat shrinkable tube 99" with a hot-melt adhesive as shown in FIG. 25. The hot-melt adhesive is melted with a heat treatment and the waterproof agent penetrates into gaps among the core wires 22".

JP,H10-125363 discloses a prior art related to a waterproof of a terminal.

The hot-melt adhesive covers around the terminal 9" but does not penetrate between the core wires 22" and a terminal base plate shown by an arrow of FIG. 25. Hence, the satisfactory waterproof between the core wires 22" are not attained in the structure of the conventional terminal 9".

SUMMARY OF THE INVENTION

An object of the present invention is to provide a terminal to be connected to covered electric wires without feazing or bending core wires and the terminal having a stable and reliable connection.

Another object of the present invention is to provide a terminal to be pressed without cutting core wires and having a stable and reliable connection.

Still another object of the present invention is to provide a terminal for allowing a waterproof agent to penetrate below core wires and having the waterproof between the core wires.

According to a first aspect of the present invention, a terminal to be connected with a bundle of covered electric wires having core wires exposed from covers includes a front portion for holding the core wires and to be connected to electric instruments, a rear portion for receiving the covered electric wires and fixing the covers of the covered electric wires with upright segments, and a middle portion communicated and opened up from the front portion to the rear portion, the front portion being formed in a shape of hollow cylinder to receive the core wires, the middle portion being partly opened from the front portion to the rear portion, and the rear portion being opened and having the upright segments.

Thereby, an opening for receiving the covered electric wires to the terminal becomes wider.

According to a second aspect of the present invention, the middle portion has an inner edge with a collapsed or chamfered face.

Thereby, the opening for receiving the covered electric wires becomes more wider.

According to a third aspect of the present invention, a step is disposed between the rear portion and the front portion, and the middle portion is tapered.

Thereby, a pulling amount of the core wires is suppressed when the front portion is pressed.

According to a fourth aspect of the present invention, the rear portion is lower than the front portion by the step.

Thereby, the pulling amount of an upper part of the core wires is suppressed when the front portion is pressed.

According to a fifth aspect of the present invention, the step is arranged to align the center of a bundle of the covered electric wires in the front portion to the center of a bundle of the covers in the rear portion.

Thereby, a cutting of the core wires is further suppressed when the front portion is pressed.

According to a sixth aspect of the present invention, a through-hole is disposed at a position through which a part of core wires is visible when covered electric wires are inserted into a rear portion of a terminal.

Thereby, a waterproof agent penetrates below the core wires uniformly.

According to a seventh aspect of the present invention, the through-hole is disposed for edges of covers to appear through the through-hole.

Thereby, a displacement in a longitudinal direction of the covered electric wires in the terminal is observed.

According to an eighth aspect of the present invention, the through-hole has an elongated shape.

Thereby, the observation of the displacement of the covered electric wires becomes easy and the waterproof agent penetrates assuredly.

DETAILED DESCRIPTION OF THE PREFERRED EMBODIMENTS

Figure 1:
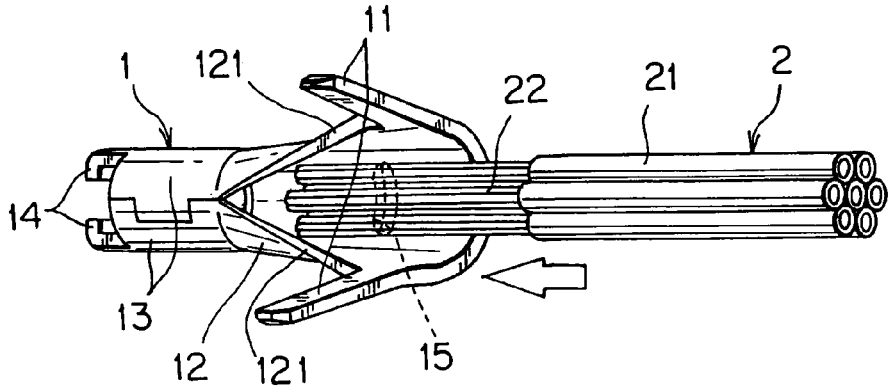
FIG. 1 is a perspective view of a terminal according to a first embodiment of the present invention.
Figure 2:
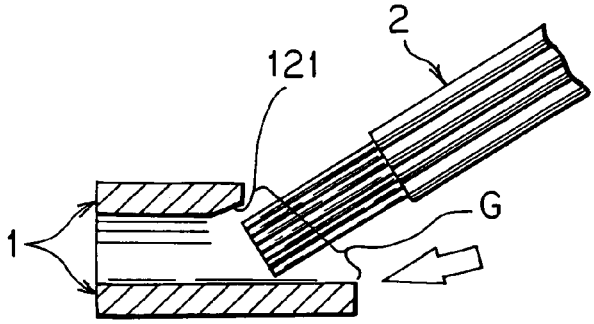
FIG. 2 is an illustration showing an insertion of covered electric wires.
Figure 3:
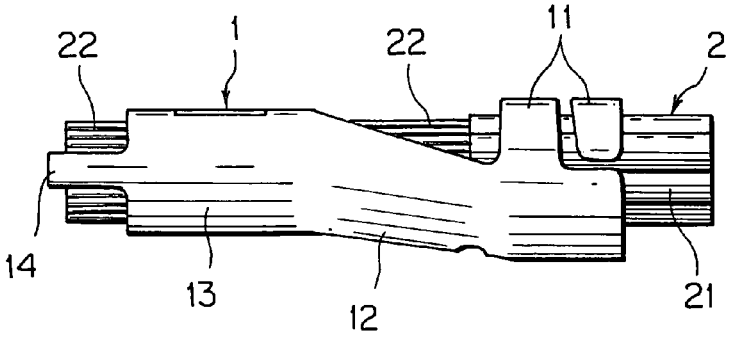
FIG. 3 is a side view showing that the covered electric wires are inserted into the terminal and upright segments are bent.

FIG. 1 is a perspective view of a terminal 1 of a first embodiment of the present invention. FIG. 2 is a sectional view of FIG. 1 and shows an insertion of covered electric wires 2. FIG. 3 is a side view of the terminal 1 fixing the covered electric wires 2 with upright segments (a rear portion 11).

As shown in FIG. 1, a bundle of the covered electric wires 2 is inserted into the terminal 1. A prescribed length of a cover 21 is removed from one end of the each covered electric wire 2 for core wires 22 to be exposed. The terminal 1 is formed integrally from a conductive metal and includes a front portion 13 to be connected to electric instruments, the rear portion 11 for inserting and fixing the covered electric wires 2 with the upright segments, and a middle portion 12 connecting the front and rear portions 13 and 11 and being partly opened up from the front portion to the rear portion.

The rear portion 11 is opened and has a pair of the upright segments. The claws are not overlapped each other when they are folded together. The front portion 13 is formed in a shape of hollow cylinder to receive the core wires 22 and has bent tips 14. The middle portion 12 is partly opened up and an inner edge of the partly opened portion has a collapsed or chamfered face 121. The detail of the terminal 1 is explained in FIGS. 4 to 6.

Figure 8:
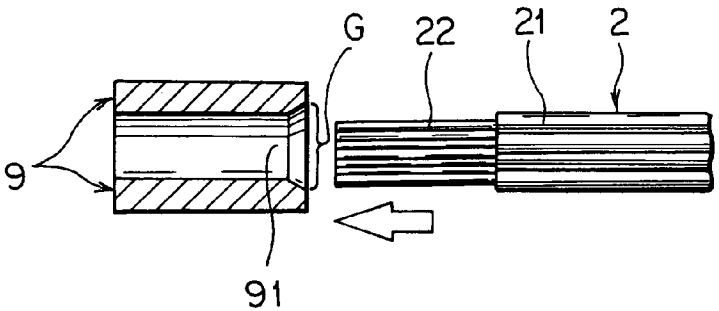
PRIOR ART FIG. 8
FIG. 8 is an illustration to explain the conventional problems.

As seen in FIG. 1, since the middle portion 12 is partly opened and its inner edge is collapsed or chamfered, the terminal 1 provides the wide opening G for receiving the covered electric wires 2 compared with FIG. 8.

The covered electric wires 2 are inserted into the terminal 1 in an arrow direction of FIGS. 1 and 2. Since the middle portion 12 is partly opened, providing the wide opening G with the chamfered face 121, and the rear portion 11 is fully opened, the core wires 22 are easily inserted into the front portion 13 guided by an inner wall of the terminal 1 (the shape of hollow cylinder of the front portion 13) without feazing and bending the core wires 22.

After the covered electric wires 2 are set into the terminal 1, the upright segments 11 are bent together as shown in FIG. 3. The covers 21 and the core wires 22 are positioned to the rear portion 11 and the front portion 13, respectively.

Figure 4A:
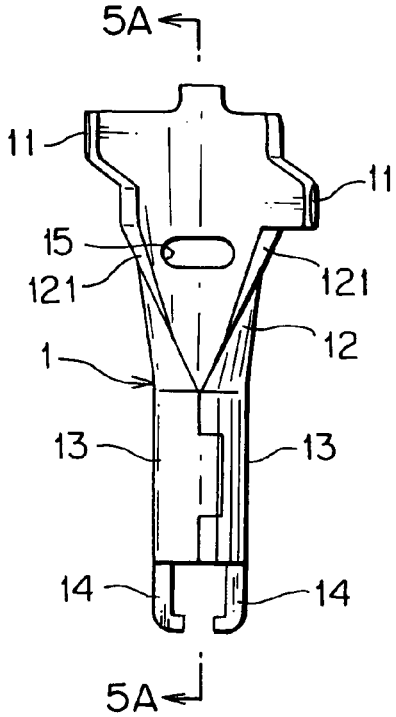
FIG. 4A is a top view of the terminal of the first embodiment of the present invention.
Figure 4C:
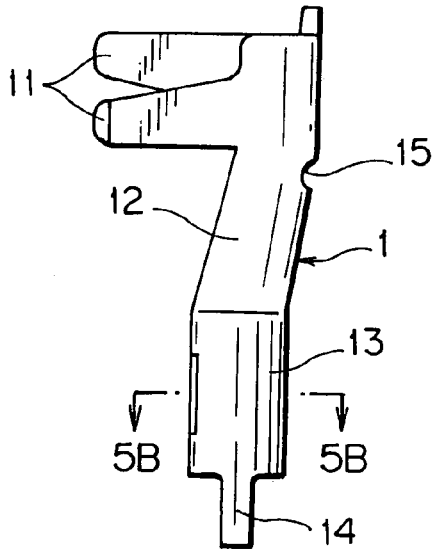
FIG. 4C is a side view of the terminal of the first embodiment of the present invention.
Figure 4B:
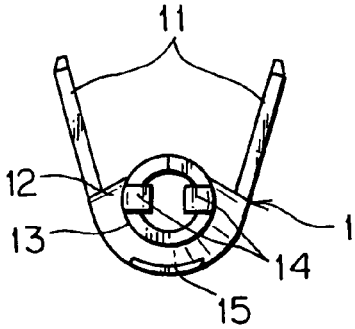
FIG. 4B is a front view of the terminal of the first embodiment of the present invention.
Figure 5A:
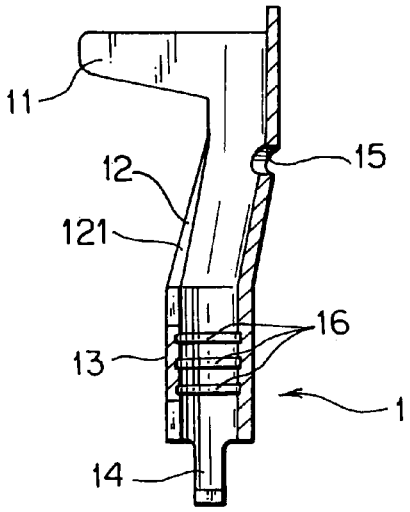
FIG. 5A is a sectional view taken along a line 5A—5A of FIG. 4A.
Figure 5B:
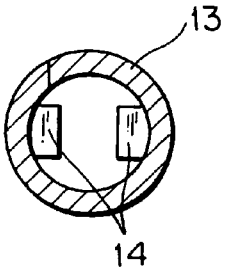
FIG. 5B is a sectional view taken along a line 5B—5B of FIG. 4C.

FIGS. 4A, 4B, and 4C are a top view, front view, and side view of the terminal of the first embodiment of the present invention, respectively. FIGS. 5A and 5B are sectional views taken along lines 5A—5A of FIGS. 4A and 5B—5B of FIG. 4C.

Figure 6:
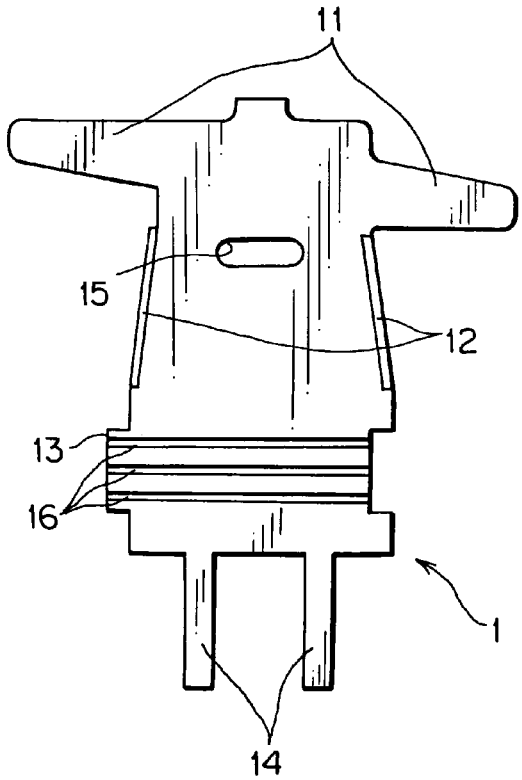
FIG. 6 is a developed view of the terminal of the first embodiment of the present invention.

FIG. 6 shows a flat terminal before formed into that of FIG. 1. Numerals of FIG. 6 are the same as those of FIGS. 1 to 5. The each portion of FIG. 1 is formed by folding back the flat terminal 1 of FIG. 6 to a suitable amount.

As shown in FIG. 4B, the upright segments 11 are upstanding in a V-shape each other.

FIG. 4A shows that the middle portion 12 is opened up from the front portion 13 to the rear portion 11. The inner edge of the middle portion 12 has the chamfered face 121. An oval through-hole 15 is disposed in an inner wall, not the opened side, of the middle portion 12 close to the rear portion 11 for a waterproof agent to penetrate.

As shown in FIGS. 4A to 4C, and FIGS. 5A and 5B, the front portion 13 is formed by folding back the flat terminal so as that a recess and a projection at each side join each other.

Three inwardly extending serrations 16 are disposed inside the inner wall of the front portion 13 as shown in FIG. 5A for marking the insertion of the covered electric wires 2 and are formed in a direction perpendicular to the core wires 22.

The covered electric wires 2 are inserted in the manner as shown in FIGS. 1 and 2, and the upright segments of the rear portion 11 and the front portion 13 are fixed manually with a hand tool or swaging machine as shown in FIG. 3. The partly opened middle portion 12 is also deformed to be closed.

The first embodiment of the terminal of the present invention provides the wide opening G with the chamfered face 121 so that the covered electric wires 2 are inserted into the terminal 1 without feazing and bending the core wires 22, resulting to a stable and reliable connection. The serrations 16 fix more firmly the core wires 22 and increases the reliability.

The present invention is also adapted to other types of covered electric wires besides the bundle of the covered electric wires of the first embodiment.

Figure 9:
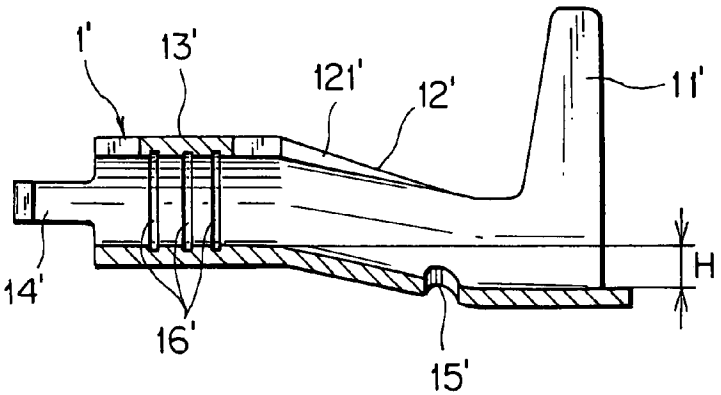
FIG. 9 is a side view of a terminal according to a second embodiment of the present invention.

FIG. 9 shows a terminal 1' according to a second embodiment of the present invention. The terminal 1' includes a front portion 13', a rear portion 11', and a middle portion 12' similarly to the first embodiment shown in FIG. 5A. In the second embodiment, a step H is disposed between the rear portion 11' and the front portion 13' so as that the middle portion 12' is downwardly tapered to the rear portion 11'.

The terminal 1' is formed integrally from a conductive metal and includes the front portion 13' to be connected to electric instruments, the rear portion 11' for receiving and fixing covered electric wires 2 with upright segments at edge of an opening, and a middle portion 12' connecting the front and rear portions 13' and 11'.

Figure 10:
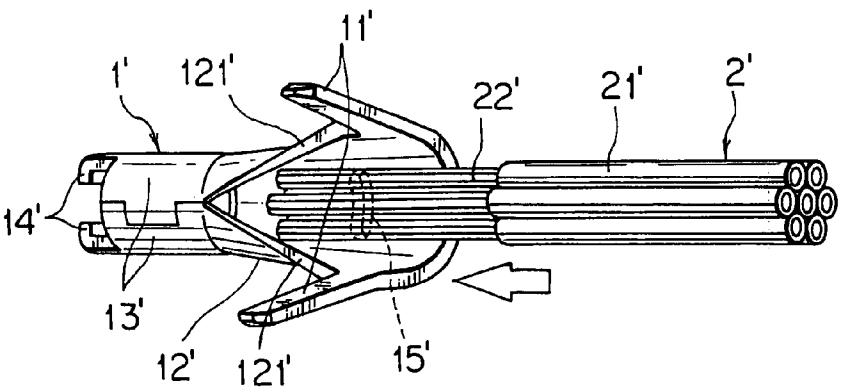
FIG. 10 is a perspective view of the terminal according to the second embodiment of the present invention.
Figure 7:
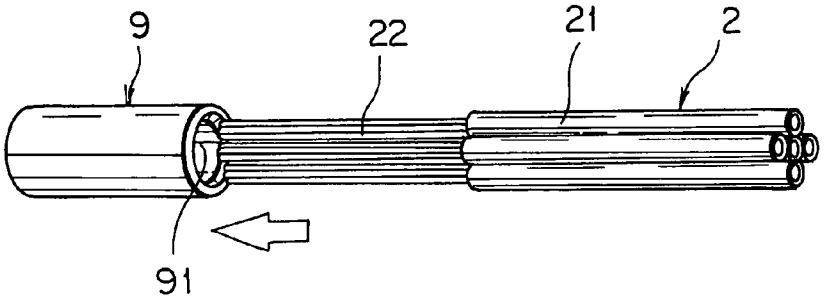
PRIOR ART FIG. 7
FIG. 7 is a perspective view showing a conventional terminal and insertion method.

As shown in FIG. 10, the rear portion 11' is opened and has a pair of upright segments. The claws are not overlapped each other when they are folded together. The front portion 13' has a shape of hollow cylinder for inserting core wires 22' and bent tips 14'. The middle portion 12' is partly opened and an inner edge of the partly opened portion has a collapsed or chamfered face 121'. The detail of the terminal 1' is explained in FIGS. 13A to 15. The inner edge of the middle portion 12 has the chamfered face 121'. An oval through-hole 15' is disposed in an inner wall, not the opened side, of the middle portion 12' close to the rear portion 11' for a waterproof agent to penetrate.

The covered electric wires 2' are inserted into the terminal 1' in an arrow direction of FIGS. 9 and 10.

Figure 11:
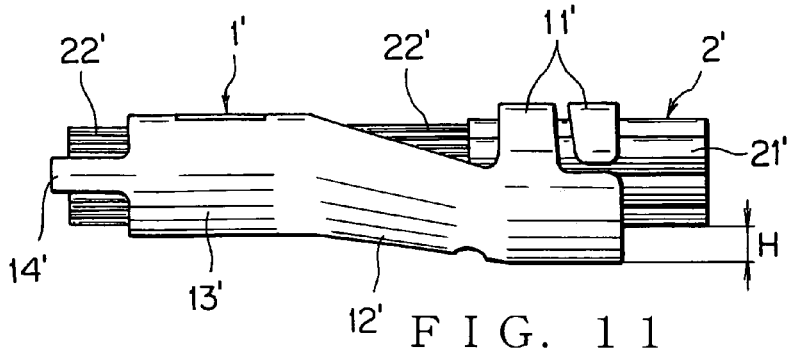
FIG. 11 is a side view showing that covered electric wires are inserted and upright segments are bent.

After the covered electric wires 2' are set into the terminal 1', the upright segments 11' are bent together as shown in FIG. 11. The covers 21' and the core wires 22' are positioned to the rear portion 11' and the front portion 13', respectively. The front portion 13' is pressed to fix the covered electric wires 2' to the terminal 1'.

Figure 17:
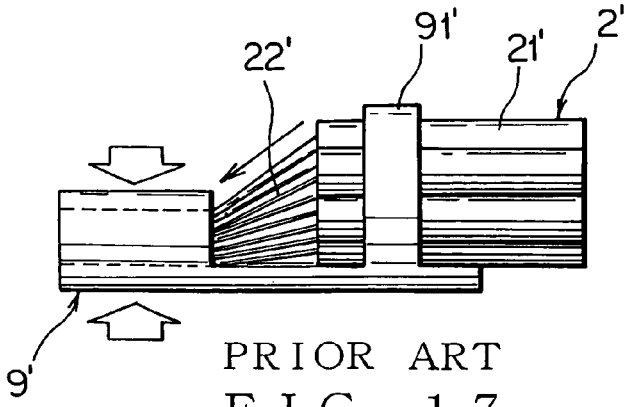
PRIOR ART FIG. 17
FIG. 17 is an illustration explaining a problem of the conventional terminal.

A front portion of the core wires 22' is pressed as shown by a large arrow and an upper portion of the core wires 22' close to the covers 21' is pulled into the slim arrow. The step H between the rear portion 11' and the front portion 13' suppresses the pulling amount and prevents the cutting of the core wires 22' so as to assure the stable and reliable connection. It is apparent when it is compared with FIG. 17.

Figure 12:
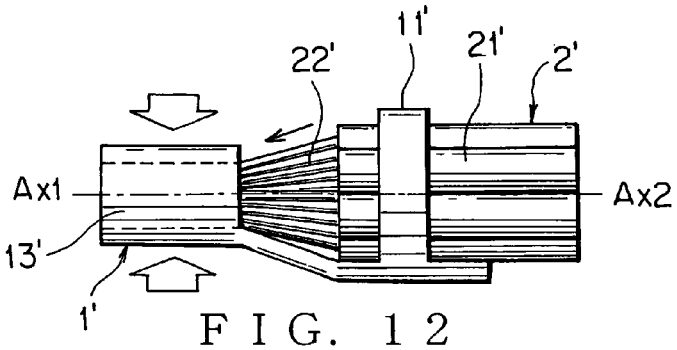
FIG. 12 is an illustration to explain an effect of the terminal according to the second embodiment of the present invention.

As shown in FIG. 12, the step H is adjusted to be the center AX1 of the gathered core wires 22' in the front portion 13' aligned with the center AX2 of the bundle of the covers 21' in the rear portion 11'. The cutting of the core wires 22' at pressing is further prevented so that the stable and reliable connection is attained.

Figure 14A:
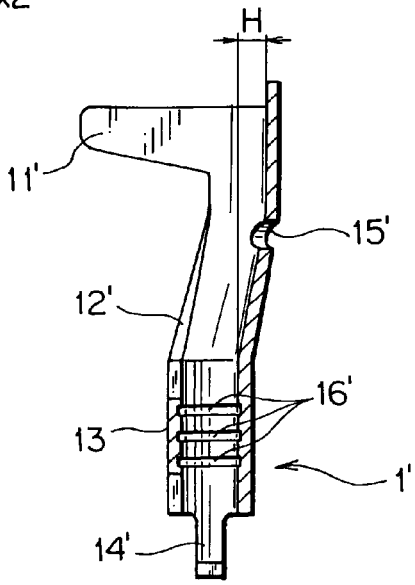
FIG. 14A is a sectional view taken along a line 14A—14A of FIG. 13A.
Figure 14B:
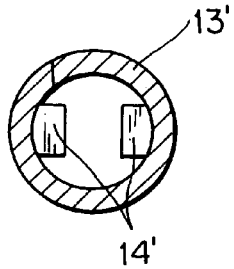
FIG. 14B is a sectional view taken along a line 14B—14B of FIG. 13C.
Figure 13A:
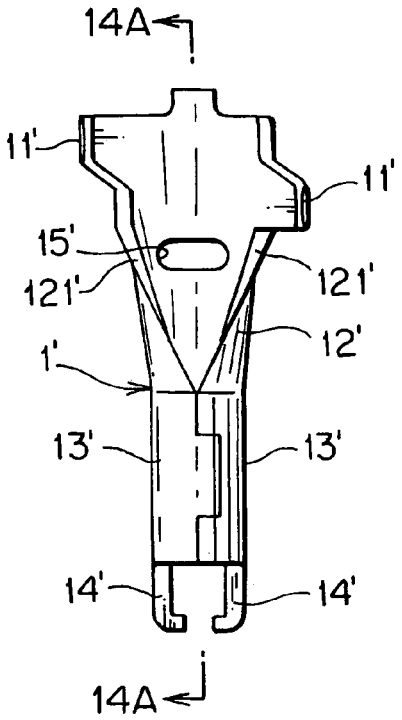
FIG. 13A is a top view of the terminal according to the second embodiment of the present invention.
Figure 13C:
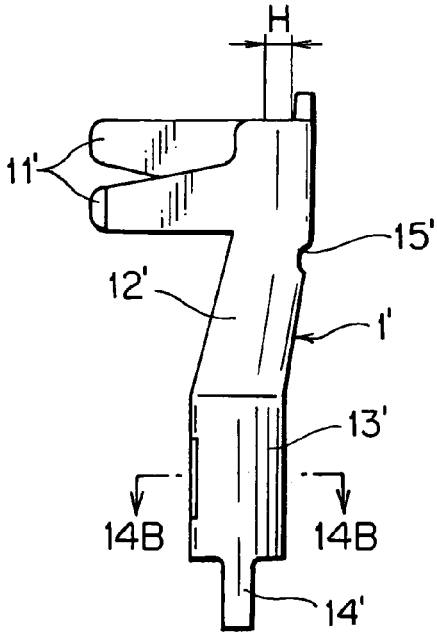
FIG. 13C is a side view of the terminal according to the second embodiment of the present invention.
Figure 13B:
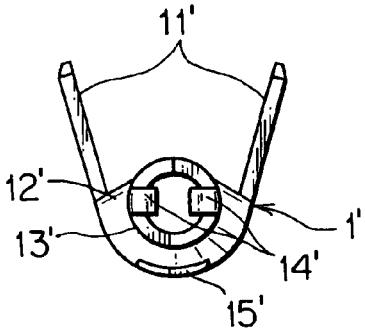
FIG. 13B is a front view of the terminal according to the second embodiment of the present invention.
Figure 16:
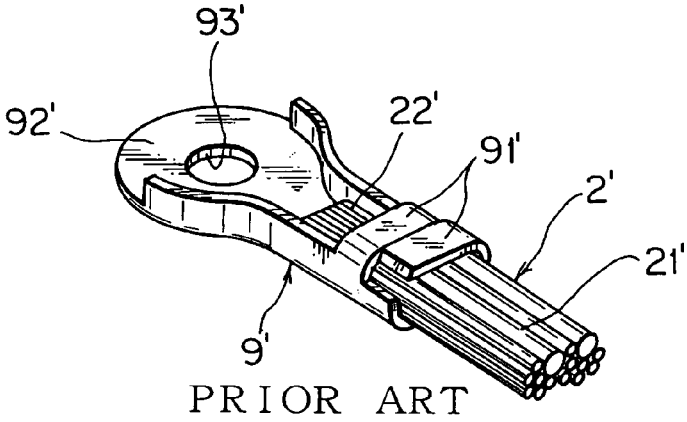
PRIOR ART FIG. 16
FIG. 16 is a perspective view of a conventional terminal.

FIGS. 13A, 13B and 13C are a top view, front view, and side view of the terminal 1' of the second embodiment of the present invention, respectively. FIGS. 14A and 14B are sectional views taken along lines 14A—14A of FIGS. 13A and 14B—14B of FIG. 13C, respectively.

Figure 15:
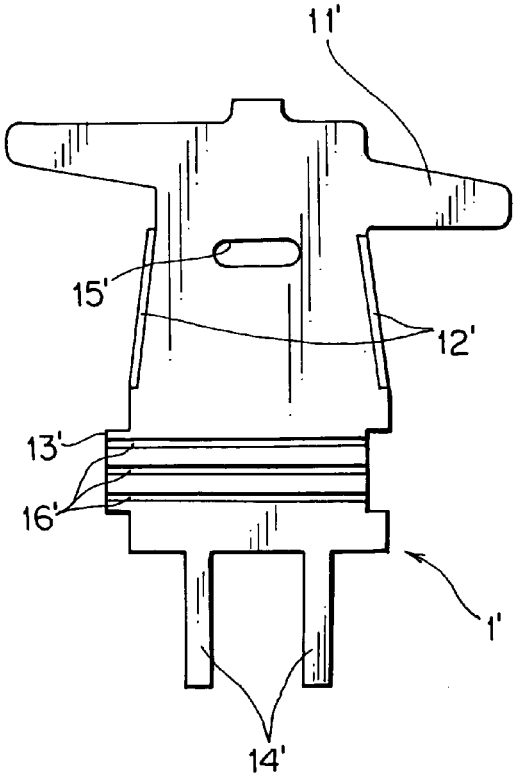
FIG. 15 is an exploded view of the terminal according to the second embodiment of the present invention.

FIG. 15 shows a flat terminal before formed into that of FIG. 13A. Numerals of FIG. 15 are the same as those of FIGS. 13A to 14B. The each portion of FIG. 10 is formed by folding back the flat terminal 1' of FIG. 15 to a suitable amount.

As shown in FIG. 13B, the upright segments 11' are upstanding in a V-shape each other.

FIG. 13A shows that the middle portion 12' is opened up from the front portion 13' to the rear portion 11'. An inner edge of the middle portion 12' has a chamfered face 121'. The oval through-hole 15' is disposed in an inner wall, not the opened side, of the middle portion 12' close to the rear portion 11' for a waterproof agent to penetrate.

As shown in FIGS. 13A to 13C, the front portion 13' is formed by folding back the flat terminal so as that a recess and a projection at each side of the flat terminal join each other.

Three inwardly extending serrations 16' are disposed inside the inner wall of the front portion 13' as shown in FIG. 14A for marking the insertion of the covered electric wires 2' and are formed in a direction perpendicular to the core wires 22' As shown in FIG. 9, the rear portion 11' is lower than the front portion 13' with the step H through the middle portion 12'.

In the second embodiment, the step H is disposed between the rear portion 11' and the front portion 13'. The middle portion 12' is tapered to the rear portion 11'. This step H suppresses the pulling amount of the core wires 22' when the front portion 13' is pressed and prevents the cutting of the core wires 22' so that the stable and reliable connection is attained. The second embodiment of the present invention is especially effective when covers 21' are thick or the difference of the bundle outer diameters of the core wires 22' and the covers 21' at the large number of the covered electric wires 2' is large.

Figure 18:
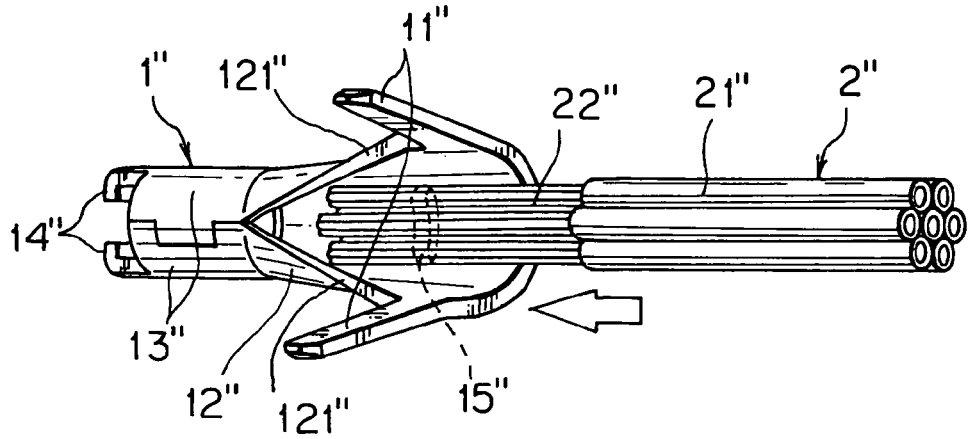
FIG. 18 is a perspective view of a terminal of a third embodiment of the present invention.
Figure 19:
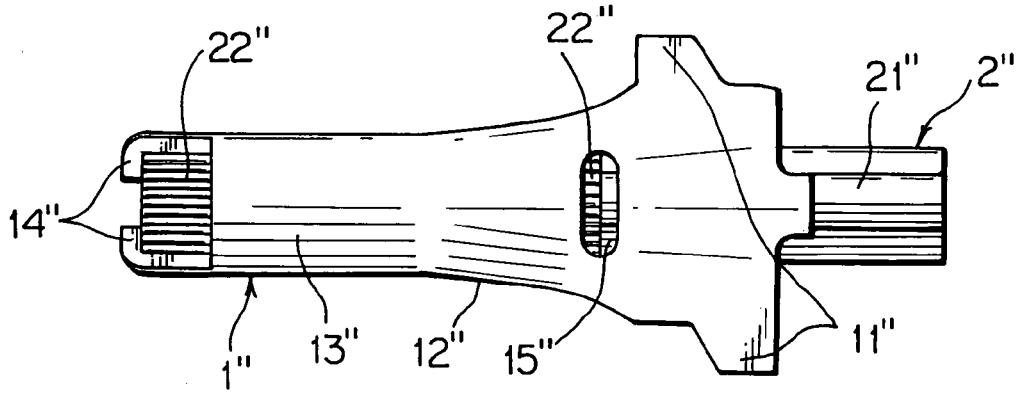
FIG. 19 is a rear view of the terminal of the third embodiment of the present invention.

FIG. 18 shows a terminal 1" of a third embodiment of the present invention. The terminal 1" is formed integrally from a conductive metal and includes a front portion 13" to be connected to electric instruments, a rear portion 11" for inserting and fixing covered electric wires 2" with the upright segments, and a middle portion 12" connecting the front and rear portions 13" and 11". As shown in FIG. 18, a bundle of the covered electric wires 2" is inserted into the terminal 1". A prescribed length of covers 21" is removed from ends of the covered electric wires 2" for core wires 22" to be exposed.

The rear portion 11" is opened and has a pair of the upright segments. The claws are not overlapped each other when they are folded together. The front portion 13" has a shape of hollow cylinder to insert the core wires 22" and bent tips 14". The middle portion 12" is partly opened and an inner edge of the partly opened portion has a collapsed or chamfered face 121".

A through-hole 15" is disposed at a wall of the middle portion 12" close to the rear portion 11". The through-hole 15" is arranged for a part of the core wires 22", preferably also edges of the covers 21", to be visible through the through-hole 15.

The covered electric wires 2" are inserted into the terminal 1" in an arrow direction of FIG. 18. The covers 21" and core wires 22" are positioned to the rear portion 11" and front portion 13", respectively so as that the edges of the covers 21" appear through the through-hole 15. The front portion 13" is pressed to fix the covered electric wires 2" to the terminal 1". In order to obtain a waterproof of the terminal 1", the terminal 1" is covered with a heat shrinkable tube 99" with a hot-melt adhesive. The hot-melt adhesive is melted with a heat treatment and the waterproof agent penetrates into gaps among the core wires 22".

Figure 20:
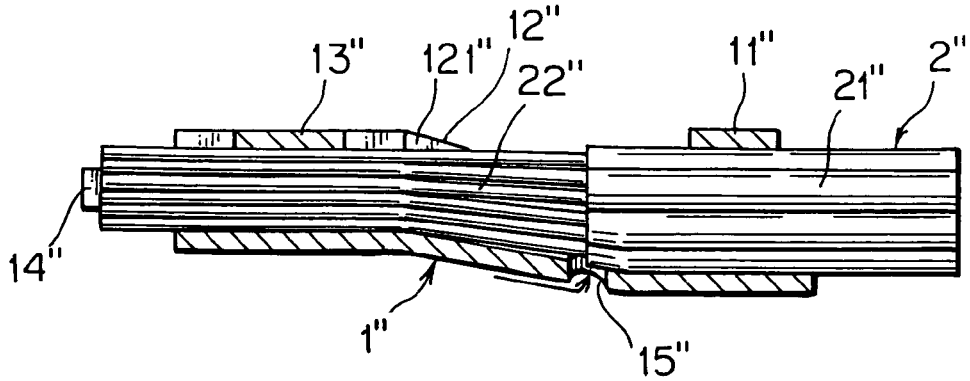
FIG. 20 is an illustration to explain an effect of the terminal according to the third embodiment of the present invention.

The through-hole 15" is arranged for the part of the core wires 22" to appear through the through-hole 15". Accordingly, the waterproof agent penetrates below the core wires 22" through the through-hole 15" as shown by an arrow of FIG. 20 and assuredly waterproofs between the core wires 22". The heat shrinkable tube 99" waterproofs the area covered.

The through-hole 15" is arranged for the edges of the covers 21" to appear through the through-hole 15" so that a position of the covered electric wires 2" along a longitudinal direction is observed and is corrected.

Since the through-hole 15" has an elongated or oval shape, it is easy to see the displacement of the covered electric wires 2". The correct position of the covers 21" assists the penetration of the waterproof agent between the core wires 22".

Figure 21A:
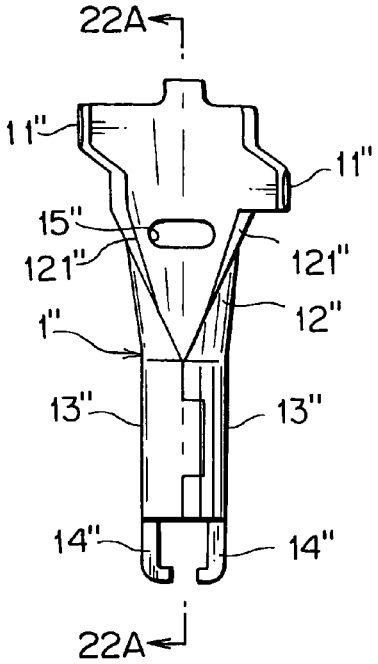
FIG. 21A is a top view of the terminal according to the third embodiment of the present invention.
Figure 21C:
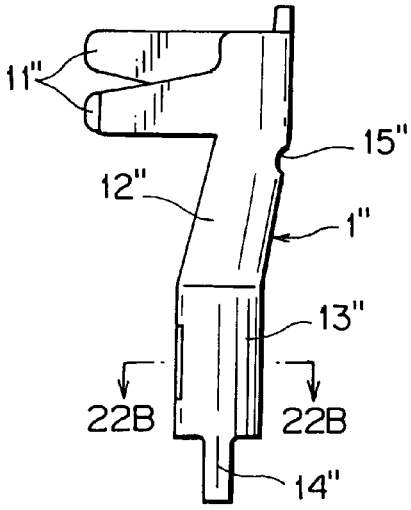
FIG. 21C is a side view of the terminal according to the third embodiment of the present invention.
Figure 21B:
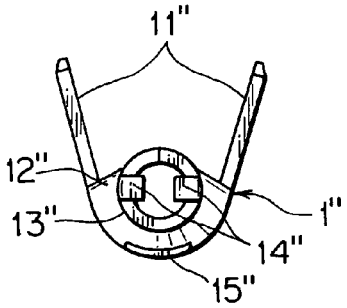
FIG. 21B is a front view of the terminal according to the third embodiment of the present invention.
Figure 22A:
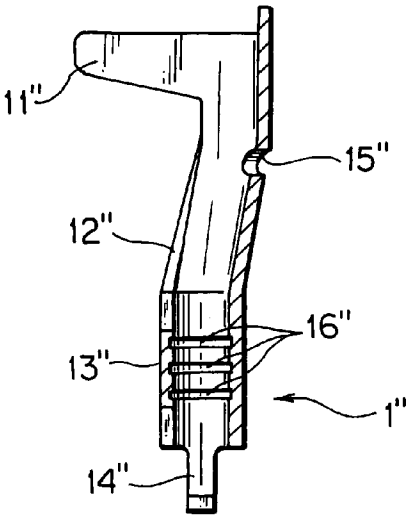
FIG. 22A is a sectional view taken along a line 22A—22A of FIG. 21A.
Figure 22B:
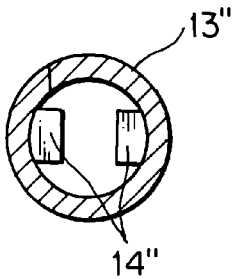
FIG. 22B is a sectional view taken along a line 22B—22B of FIG. 21C.

FIGS. 21A, 21B, and 21C are a top view, front view, and side view of the terminal of the third embodiment of the present invention, respectively. FIGS. 22A and 22B are sectional views taken along lines 22A—22A of FIGS. 21A and 22B—22B of FIG. 21C.

Figure 23:
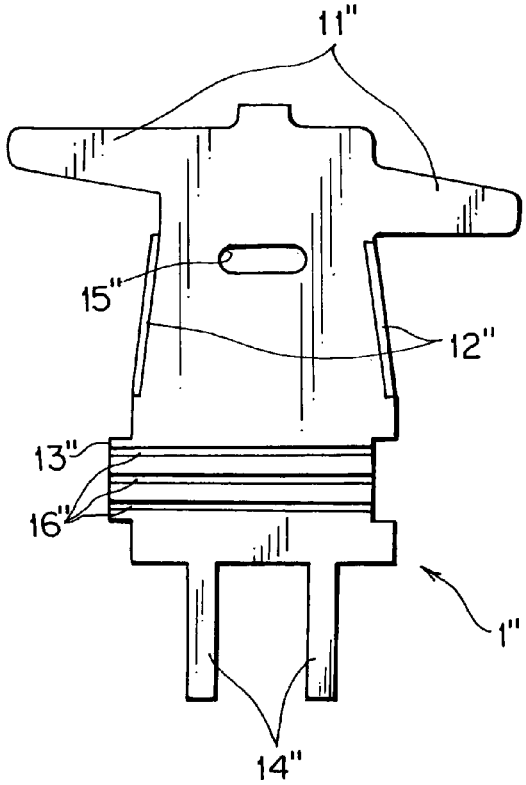
FIG. 23 is an exploded view of the terminal according to the third embodiment of the present invention.
Figure 24:
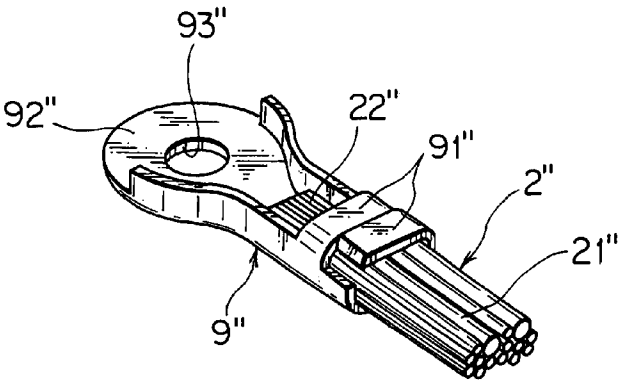
PRIOR ART FIG. 24
FIG. 24 is a perspective view of a conventional terminal.
Figure 25:
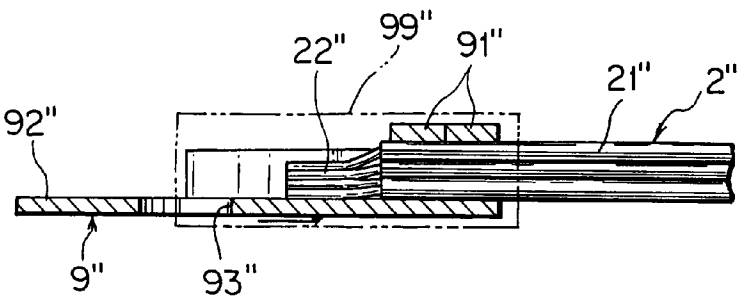
PRIOR ART FIG. 25
FIG. 25 is an illustration explaining a problem of the conventional terminal.

FIG. 23 shows a flat terminal before formed into that of FIG. 21A. Numerals of FIG. 23 are the same as those of FIGS. 18 to 22B. The each portion of FIG. 18 is formed by folding back the flat terminal 1" of FIG. 23 to a suitable amount.

As shown in FIG. 21B, the upright segments 11" are upstanding in a V-shape each other.

FIG. 21A shows that the middle portion 12" is opened up from the front portion 13" to the rear portion 11". The inner edge of the middle portion 12" has the chamfered face 121. The through-hole 15" is disposed in an inner wall, not the opened side, of the middle portion 12" close to the rear portion 11" for the waterproof agent to penetrate.

Referring to FIGS. 21A and 23, the front portion 13" is formed by folding back the flat terminal 1" so as that a recess and a projection at each side of the flat terminal 1" join each other.

Three inwardly extending serrations 16" are disposed inside the inner wall of the front portion 13" as shown in FIG. 22A for marking the insertion of the covered electric wires 2" and are formed in a direction perpendicular to the core wires 22".

The through-hole 15" can be arranged any portion besides the middle portion 12" of the third embodiment. It is not necessary for the edges of the covers 21" to appear through the through-hole 15" as far as the core wires 22" appear through the through-hole 15" for the waterproof agent to penetrate. The shape and number of the through-hole 15" is not limited to be oval and single, respectively.

The invention claimed is:

1. A terminal to be connected with a bundle of covered electric wires having core wires exposed from respective covers, comprising:

a front portion for holding the core wires and to be connected to electric instruments;

a rear portion for receiving the covered electric wires and fixing the covers of the covered electric wires by folding upright segments with pressure;

a middle portion communicated to the front portion and the rear portion, and said middle portion having a through-hole at a position through which a part of the core wires is visible when the covered electric wires are inserted into the rear portion of the terminal, wherein, said front portion is formed in a shape of a hollow cylinder to receive the core wires, the middle portion opposite to the through-hole is partly opened up from the front portion to the rear portion, and the rear portion is opened and has the upright segments at an edge of the opening.

2. The terminal as claimed in claim 1, wherein said middle portion has an inner edge with a collapsed or chamfered face facing inwardly said rear portion.

3. The terminal as claimed in claim 1, wherein said middle portion is tapered so as to have a step between the rear portion and the front portion.

4. The terminal as claimed in claim 3, wherein said rear portion is lower than the front portion by the step.

5. The terminal as claimed in claim 3, wherein the center of a bundle of the core wires is aligned with the center of a bundle of the covered electric wires.

6. The terminal as claimed in claim 1, wherein said through-hole is disposed at the position from where edges of the covers are visible.

7. The terminal as claimed in claim 6, wherein said through-hole has an elongated shape.

8. The terminal as claimed in claim 2, wherein said middle portion is tapered so as to have a step between the rear portion and the front portion.

9. The terminal as claimed in claim 8, wherein said rear portion is lower than the front portion by the step.

10. The terminal as claimed in claim 8, wherein the center of a bundle of the core wires is aligned with the center of a bundle of the covered electric wires.

* * * * *